US011693340B2

(12) United States Patent
Mitamura et al.

(10) Patent No.: US 11,693,340 B2
(45) Date of Patent: Jul. 4, 2023

(54) IMAGE FORMING APPARATUS

(71) Applicant: FUJIFILM Business Innovation Corp., Tokyo (JP)

(72) Inventors: Naoya Mitamura, Kanagawa (JP); Kanji Watanabe, Kanagawa (JP); So Endo, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/546,576

(22) Filed: Dec. 9, 2021

(65) Prior Publication Data

US 2023/0055653 A1 Feb. 23, 2023

(30) Foreign Application Priority Data

Aug. 23, 2021 (JP) ..... 2021-135292

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS

2011/0233856 A1* 9/2011 Okamura ..... G03G 15/70 271/227
2018/0203384 A1* 7/2018 Okamoto ..... G03G 15/2025

FOREIGN PATENT DOCUMENTS

JP 2018-54949 A 4/2018

* cited by examiner

*Primary Examiner* — Clayton E. LaBalle
*Assistant Examiner* — Michael A Harrison
(74) *Attorney, Agent, or Firm* — Oliff PLC

(57) ABSTRACT

An image forming apparatus includes: a paper feeding part that houses a medium to be fed; a belt-shaped image holding part that holds an image on a surface of the image holding part and rotates; a transfer part disposed to face the image holding part and transfers an image onto a medium from the image holding part in a final transfer region; and a cleaning part that removes a deposit on the surface of the image holding part passed through the final transfer region, in which a downstream side of the paper feeding part in a transport direction of a medium is inclined to be closer than an upstream side of the paper feeding part to the final transfer region, and the image holding part is inclined upward on a downstream side of the final transfer region toward the downstream side in a rotation of the image holding part.

9 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2021-135292 filed Aug. 23, 2021.

BACKGROUND

(i) Technical Field

The present disclosure relates to an image forming apparatus.

(ii) Related Art

For image forming apparatus including copiers, printers, facsimile machines, and the like, the technology described in Japanese Unexamined Patent Application Publication No. 2018-054949 (paragraphs [0016] and [0033], FIG. 1) is known.

Japanese Unexamined Patent Application Publication No. 2018-054949 describes a configuration that suppresses the height of a printer (U) by disposing a paper-feeding tray (TR1) disposed in the printer (U) in a state in which the paper-feeding side is disposed to be raised and in which the paper-feeding tray (TR1) is disposed to be inclined with respect to the direction of gravity and the horizontal direction.

SUMMARY

Aspects of non-limiting embodiments of the present disclosure relate to a technology that suppresses the amount of paper dust adhering to a belt-shaped image holding part and transported toward a cleaning part in an image forming apparatus in which the downstream side of a paper feeding part in a transport direction of a medium is inclined to be above the upstream side thereof, compared with a case in which the paper feeding part is inclined downward toward the downstream side on the downstream side of a final transfer region in a rotation direction of the belt-shaped image holding part.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus that includes: a paper feeding part that houses a medium that is to be fed; a belt-shaped image holding part that holds an image on a surface of the image holding part and rotates; a transfer part that is disposed to face the image holding part and that transfers an image onto a medium from the image holding part in a final transfer region; and a cleaning part that removes a deposit on the surface of the image holding part that has passed through the final transfer region, in which a downstream side of the paper feeding part in a transport direction of a medium is inclined to be closer than an upstream side of the paper feeding part to the final transfer region in a direction of gravity, and in which the image holding part is inclined upward on a downstream side of the final transfer region toward the downstream side in a rotation direction of the image holding part.

BRIEF DESCRIPTION OF THE DRAWINGS

An exemplary embodiment of the present disclosure will be described in detail based on the following figures, wherein.

DETAILED DESCRIPTION

Figure 1:
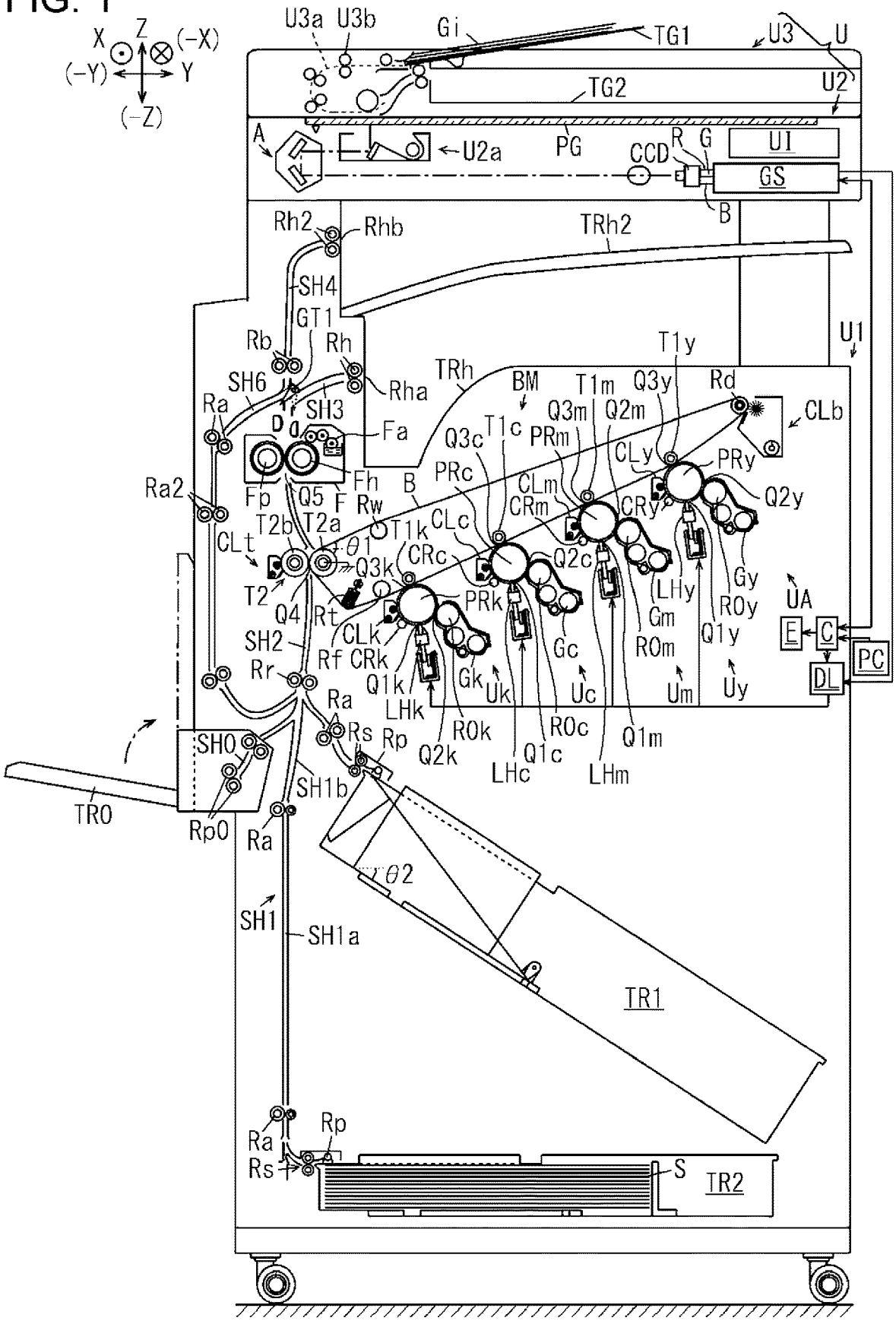
FIG. 1 is a general explanatory view of an image forming apparatus according to Example 1.

Next, specific examples (hereinafter referred to as examples) of an exemplary embodiment of the present disclosure will be described with reference to the drawings. The present disclosure is, however, not limited to the following examples.

For ease of understanding of the following description, in the drawings, the front-rear direction is denoted by the X-axis direction, the left-right direction is denoted by the Y-axis direction, the up-down direction is denoted by the Z-axis direction, and directions or sides indicated by the arrows X, −X, Y, −Y, Z, and −Z denote the front direction, the rear direction, the right direction, the left direction, the up direction, and the down direction, or the front side, the rear side, the right side, the left side, the upper side, and the lower side, respectively.

In the drawings, a middle dot in a circle denotes an arrow from the rear toward the front of the drawings, and a cross in a circle denotes an arrow from the front toward the rear of the drawings.

Note that in the following description with reference to the drawings, illustration of members other than members required for the description is omitted, as appropriate, for ease of understanding.

Example 1

FIG. 1 is a general explanatory view of an image forming apparatus according to Example 1.

In FIG. 1, a copier U as one example of the image forming apparatus according to Example 1 of the present disclosure includes a printer U1 as one example of an image recorder. A scanner U2 as one example of a reading unit and as one example of an image reading device is supported above the printer U1. An autofeeder U3 as one example of a document transporting device is supported above the scanner U2.

A document tray TG1 as one example of a medium housing part is disposed above the autofeeder U3. On the document tray TG1, multiple documents Gi that are to be copied can be stacked and housed. A paper output tray TG2 for documents as one example of a document discharge part is formed below the document tray TG1. Between the document tray TG1 and the paper output tray TG2 for documents, a document transport roller U3*b* is disposed along a document transport path U3*a*.

A platen glass PG as one example of a transparent document table is disposed at the upper surface of the scanner U2. In the scanner U2 according to Example 1, a reading unit U2*a* as one example of a reader is disposed below the platen glass PG. The reading unit U2*a* according to Example 1 is supported along the lower surface of the platen glass PG to be movable in the left-right direction as one example of a sub-scanning direction. The reading unit U2*a* is electrically connected to the image processor GS.

The image processor GS is electrically connected to a writing circuit DL of the printer U1. The writing circuit DL is electrically connected to exposure devices LHy, LHm, LHc, and LHk as one example of a latent image formation unit.

The exposure devices LHy to LHk according to Example 1 are configured by, for example, an LED head in which multiple LEDs are arranged in a main scanning direction. The exposure devices LHy to LHk are configured to be able to output writing light corresponding to each of colors of Y, M, C, and K in accordance with a signal that is input from the writing circuit DL.

The writing timing of the writing circuit DL and the power supply timing of a power supply circuit E are controlled in accordance with a control signal from a controller C as one example of a control unit.

In FIG. 1, photoreceptors PRy, PRm, PRc, and PRk as one example of an image holding part are disposed above the exposure devices LHy to LHk. In FIG. 1, writing regions Q1*y*, Q1*m*, Q1*c*, and Q1*k* are configured by regions in which writing light is radiated with respect to each of the photoreceptors PRy to PRk.

Charging rollers CRy, CRm, CRc, and CRk as one example of a charging part are disposed on the upstream side of the writing regions Q1*y* to Q1*k* in a rotation direction of the photoreceptors PRy to PRk. The charging rollers CRy to CRk according to Example 1 are supported in contact with the photoreceptors PRy to PRk to be rotatable by following the photoreceptors PRy to PRk.

Developing devices Gy, Gm, Gc, and Gk as one example of a developing unit are disposed on the downstream side of the writing regions Q1*y* to Q1*k* in the rotation direction of the photoreceptors PRy to PRk. Developing regions Q2*y*, Q2*m*, Q2*c*, and Q2*k* are configured by regions in which the photoreceptors PRy to PRk and the developing devices Gy to Gk face each other.

Primary transfer rollers T1*y*, T1*m*, T1*c*, and T1*k* as one example of a primary transfer part are disposed on the downstream side of the developing devices Gy to Gk in the rotation direction of the photoreceptors PRy to PRk. Primary transfer regions Q3*y*, Q3*m*, Q3*c*, and Q3*k* are configured by regions in which the photoreceptors PRy to PRk and the primary transfer rollers T1*y* to T1*k* face each other.

Photoreceptor cleaners CLy, CLm, CLc, and CLk as one example of a cleaning part are disposed on the downstream side of the primary transfer rollers T1*y* to T1*k* in the rotation direction of the photoreceptors PRy to PRk.

As one example of a yellow-visible-image formation unit according to Example 1, a yellow image former Uy that forms a yellow toner image is configured by the photoreceptor PRy, the charging roller CRy, the exposure device LHy, the developing device Gy, the primary transfer roller T1*y*, and the photoreceptor cleaner CLy that are for yellow. Similarly, a magenta image former Um, a cyan image former Uc, and a black image former Uk are configured by the photoreceptors PRm, PRc, and PRk, the charging rollers CRm, CRc, and CRk, the exposure devices LHm, LHc, and LHk, the developing devices Gm, Gc, and Gk, the primary transfer rollers T1*m*, T1*c*, and T1*k*, and the photoreceptor cleaners CLm, CLc, and CLk, respectively.

A belt module BM as one example of an intermediate transfer device is disposed above the photoreceptors PRy to PRk. The belt module BM includes an intermediate transfer belt B as one example of an image holding part and as one example of an intermediate transfer part. The intermediate transfer belt B is configured by an endless belt-shaped member.

The intermediate transfer belt B according to Example 1 is rotatably supported by a tension roller Rt as one example of a stretching part, a walking roller Rw as one example of a deviation correcting part, an idler roller Rf as one example of a driven part, a backup roller T2*a* as one example of a part that faces a secondary transfer region, the primary transfer rollers T1*y* to T1*k*, and a drive roller Rd as one example of a driving part. In Example 1, the intermediate transfer belt B is rotated in response to a driving force being transmitted to the drive roller Rd.

A secondary transfer roller T2*b* as one example of a secondary transfer part is disposed at a position facing the backup roller T2*a* with the intermediate transfer belt B interposed therebetween. As one example of a transfer device, a secondary transfer unit T2 according to Example 1 is configured by the backup roller T2*a*, the secondary transfer roller T2*b*, and the like. A secondary transfer region Q4 is configured by a region in which the secondary transfer roller T2*b* and the intermediate transfer belt B are in contact with each other.

A belt cleaner CLb as one example of an intermediate-transfer-body cleaning device is disposed on the downstream side of the secondary transfer region Q4 in a rotation direction of the intermediate transfer belt B.

A transfer device T1+T2+B according to Example 1 as one example of a transfer part is configured by the primary transfer rollers T1*y* to T1*k*, the intermediate transfer belt B, the secondary transfer unit T2, and the like. An image recorder Uy to Uk+T1+T2+B according to Example 1 is configured by the image formers Uy to Uk and the transfer device T1+T2+B.

In Example 1, the walking roller Rw as one example of a second supporting part is disposed above the backup roller T2*a* as one example of a first supporting part in the direction of gravity. In other words, the walking roller Rw that is disposed immediately downstream of the backup roller T2*a* is disposed above the backup roller T2*a* in the direction of gravity. In Example 1, the drive roller Rd is disposed above the walking roller Rw in the direction of gravity. Therefore, on the downstream side of the secondary transfer region Q4 as one example of a final transfer region, the intermediate transfer belt B according to Example 1 is inclined upward toward the downstream side in the rotation direction of the intermediate transfer belt B. In Example 1, an angle θ1 formed by a surface of the intermediate transfer belt B that has passed through the secondary transfer region Q4 with respect to the horizontal direction is set to, for example, 15°.

The belt cleaner CLb according to Example 1 is disposed to face the drive roller Rd.

In Example 1, a configuration in which the walking roller Rw is disposed between the backup roller T2*a* and the drive roller Rd is exemplified. The configuration is, however, not limited thereto. In the configuration, the walking roller Rw may be disposed at the position of the idler roller Rf, or a different mechanism that corrects deviation may be provided without the provision of the walking roller Rw. In these cases, the second supporting part is the drive roller Rd, and the drive roller Rd functions as both the second supporting part and the driving part. When the drive roller Rd functions as both the second supporting part and the driving part, the number of components may be reduced. Meanwhile, by disposing the second supporting part (walking roller Rw) and the driving part (drive roller Rd) individually, as in Example 1, it may be possible to move each of the positions of the second supporting part and the driving part. Thus, flexibility in design may be increased, and it may become easy to cope with the orientation of the intermediate transfer belt B, restriction of the internal space of the copier U, and the like.

In FIG. 1, paper-feeding trays TR1 and TR2 as one example of a paper feeding part are disposed below the image formers Uy to Uk. The paper-feeding trays TR1 and TR2 are supported to be extractable and insertable in the front-rear direction. Recording paper S as one example of a medium is housed on the paper-feeding trays TR1 and TR2.

In Example 1, the first paper-feeding tray TR1 on the upper side is disposed to be inclined upward from the right side, which is the upstream side in the transport direction of the recording paper S, toward the left side, which is the downstream side. In Example 1, an inclination angle θ2 of the bottom surface of the first paper-feeding tray TR1 with respect to the horizontal direction is set to 35°.

The second paper-feeding tray TR2 on the lower side is disposed horizontally in the transport direction of recording paper. Therefore, in Example 1, the maximum size of the recording paper S that can be housed on the first paper-feeding tray TR1 on the upper side is larger than that of the recording paper S that can be housed on the second paper-feeding tray TR2.

A pickup roller Rp as one example of a take-out part is disposed on the upper left side of each of the paper-feeding trays TR1 and TR2. A handling roller Rs as one example of a handling part is disposed on the downstream side of the pickup roller Rp in the transport direction of the recording paper S. As one example of a medium transport path, a paper-feeding path SH1 extending upward is formed on the downstream side of the handling roller Rs in the transport direction of the recording paper S. Multiple transport rollers Ra as one example of a transporting part are disposed in the paper-feeding path SH1.

A manual feeding tray TR0 as one example of a paper feeding part is disposed at a lower left portion of the copier U. At an upper right portion of the manual feeding tray TR0, a pickup roller Rp0 is disposed, and a manual paper-feeding path SH0 extends. The manual paper-feeding path SH0 joins the paper-feeding path SH1.

In the paper-feeding path SH1, a registration roller Rr as one example of a transport-timing adjuster is disposed on the upstream side of the secondary transfer region Q4. A transport path SH2 extends from the registration roller Rr toward the secondary transfer region Q4.

A fixing device F as one example of a fixing unit is disposed on the downstream side of the secondary transfer region Q4 in the transport direction of the recording paper S. The fixing device F includes a heating roller Fh as one example of a fixing member for heating and a pressurizing roller Fp as one example of a fixing member for pressurizing. A fixation region Q5 is configured by a region in which the heating roller Fh and the pressurizing roller Fp are in contact with each other.

A lower paper output tray TRh as one example of a medium discharge part is formed at the upper surface of the printer U1. Above the fixing device F, a paper output path SH3 as one example of a transport path extends toward the lower paper output tray TRh. A paper output roller Rh as one example of a medium transporting part is disposed at the downstream end of the paper output path SH3.

An upper paper output tray TRh2 as one example of a medium discharge part is disposed above the lower paper output tray TRh. An upper transport path SH4 that branches from the paper output path SH3 and that extends toward the upper paper output tray TRh2 is formed above the fixing device F.

As one example of a medium transporting part, a reversing roller Rb that is rotatable forwardly and reversely is disposed in the upper transport path SH4. Above a position at which the upper transport path SH4 branches from the paper output path SH3, a reversing path SH6 as one example of a medium transport path branches from the upper transport path SH4 toward the lower left side.

A gate GT1 as one example of a switching part is disposed across a part where the upper transport path SH4 branches from the paper output path SH3 and a part where the reversing path SH6 branches from the upper transport path SH4. The gate GT1 is supported to be switchable between a first guide position (second position) at which the recording paper S from the fixing device F is guided toward the lower paper output tray TRh and at which the recording paper S is guided from the upper transport path SH4 to the reversing path SH6 and a second guide position (first position) at which the recording paper S from the fixing device F is guided to the upper transport path SH4.

The multiple transport rollers Ra as one example of a medium transporting part are disposed in the reversing path SH6. The downstream end of the reversing path SH6 joins the paper-feeding path SH1 on the upstream side of the registration roller Rr.

Image Formation Operation

In the copier U according to Example 1 having the configuration, when an operator manually places the document Gi on the platen glass PG to copy the document Gi, the reading unit U2*a* moves from an initial position in the left-right direction, and the document Gi on the platen glass PG is scanned while being exposed to light. When the autofeeder U3 is used to automatically transport and copy the document Gi, multiple documents Gi housed on the document tray TG1 are sequentially transported to and pass through a document reading position on the platen glass PG and discharged onto the paper output tray TG2 for documents. Each document Gi that sequentially passes through the reading position on the platen glass PG is exposed to light and scanned by the reading unit U2*a*. Reflection light from the document Gi is received by the reading unit U2*a*. The reading unit U2*a* converts the received reflection light reflected by the document Gi into electric signals. When both faces of the document Gi are to be read, the document Gi is also read by a reading sensor.

The image processor GS receives electric signals that are output from the reading unit U2*a*. The image processor GS converts electric signals of an image of colors of R, G, and B read by the reading unit U2*a* into image information of yellow (Y), magenta (M), cyan (C), and black (K) for latent image formation. The image processor GS outputs image information after conversion to the writing circuit DL of the printer U1. When an image is a single color image, that is monochromatic, the image processor GS outputs image information of only black (K) to the writing circuit DL.

The writing circuit DL outputs a control signal corresponding to inputted image information to the exposure devices LHy to LHk. The exposure devices LHy to LHk output writing light corresponding to the control signal.

Each of the photoreceptors PRy to PRk is driven to rotate when image formation is started. A charging voltage is applied to the charging rollers CRy to CRk from the power supply circuit E. Consequently, surfaces of the photoreceptors PRy to PRk are charged by the charging rollers CRy to CRk. In the writing regions Q1*y* to Q1*k*, latent images are formed on surfaces of the charged photoreceptors PRy to PRk by the exposure devices LHy to LHk. In the developing regions Q2*y* to Q2*k*, the latent images on the photoreceptors PRy to PRk are developed into toner images as one example of a visible image by the developing devices Gy to Gk.

The developed toner images are transported to the primary transfer regions Q3*y* to Q3*k* in contact with the intermediate transfer belt B as one example of an intermediate transfer body. In the primary transfer regions Q3*y* to Q3*k*, a primary transfer voltage having a polarity opposite to a charge polarity of toner is applied from the power supply circuit E to the primary transfer rollers T1*y* to T1*k*. Consequently, the toner images on the photoreceptors PRy to PRk are transferred onto the intermediate transfer belt B by the primary transfer rollers T1*y* to T1*k*. In the case of multicolor toner images, a toner image transferred on the intermediate transfer belt B in the primary transfer region on the upstream side is overlaid with a toner image on the downstream side.

Residues and deposits on the photoreceptors PRy to PRk after primary transfer are removed by the photoreceptor cleaners CLy to CLk. The surfaces of the cleaned photoreceptors PRy to PRk are recharged by the charging rollers CRy to CRk.

A single-color or multicolor toner image transferred on the intermediate transfer belt B by the primary transfer rollers T1*y* to T1*k* in the primary transfer regions Q3*y* to Q3*k* is transported to the secondary transfer region Q4.

The recording paper S on which an image is to be recorded is taken out by the pickup roller Rp of the paper-feeding tray TR1 or TR2 that is to be used. When multiple sheets of the recording paper S are taken out in a stacked state by the pickup roller Rp, the sheets of the recording paper S are separated to be individual sheets by the handling roller Rs. The recording paper S separated by the handling roller Rs is transported in the paper-feeding path SH1 by the transport rollers Ra. The recording paper S transported in the paper-feeding path SH1 is sent to the registration roller Rr. The recording paper S stacked on the manual feeding tray TR0 is also sent to the paper-feeding path SH1 through the manual paper-feeding path SH0 by the pickup roller Rp0.

The registration roller Rr transports the recording paper S to the secondary transfer region Q4 at a timing when a toner image formed on the intermediate transfer belt B is transported to the secondary transfer region Q4. A secondary transfer voltage having a polarity opposite to a charge polarity of toner is applied to the secondary transfer roller T2*b* by the power supply circuit E. Consequently, the toner image on the intermediate transfer belt B is transferred from the intermediate transfer belt B onto the recording paper S.

Deposits and the like adhering to the surface of the intermediate transfer belt B after secondary transfer are removed by the belt cleaner CLb.

The recording paper S on which the toner image is secondarily transferred is heated and fixed when passing through the fixation region Q5.

To discharge the recording paper S on which an image is fixed onto the lower paper output tray TRh, the gate GT1 moves to the first guide position. Consequently, the recording paper S sent from the fixing device F is transported in the paper output path SH3. The recording paper S transported in the paper output path SH3 is discharged onto the lower paper output tray TRh by the paper output roller Rh.

To discharge the recording paper S onto the upper paper output tray TRh2, the gate GT1 moves to the second guide position so that the recording paper S is discharged onto the upper paper output tray TRh2.

When the recording paper S is to be subjected to double-sided printing, the gate GT1 moves to the second guide position. When the rear end of the recording paper S has passed through the gate GT1, the gate GT1 moves to the first guide position, and the reversing roller Rb rotates reversely. Consequently, the recording paper S is guided by the gate GT1 to be sent to the reversing path SH6.

Operation in Example 1

Figure 2:
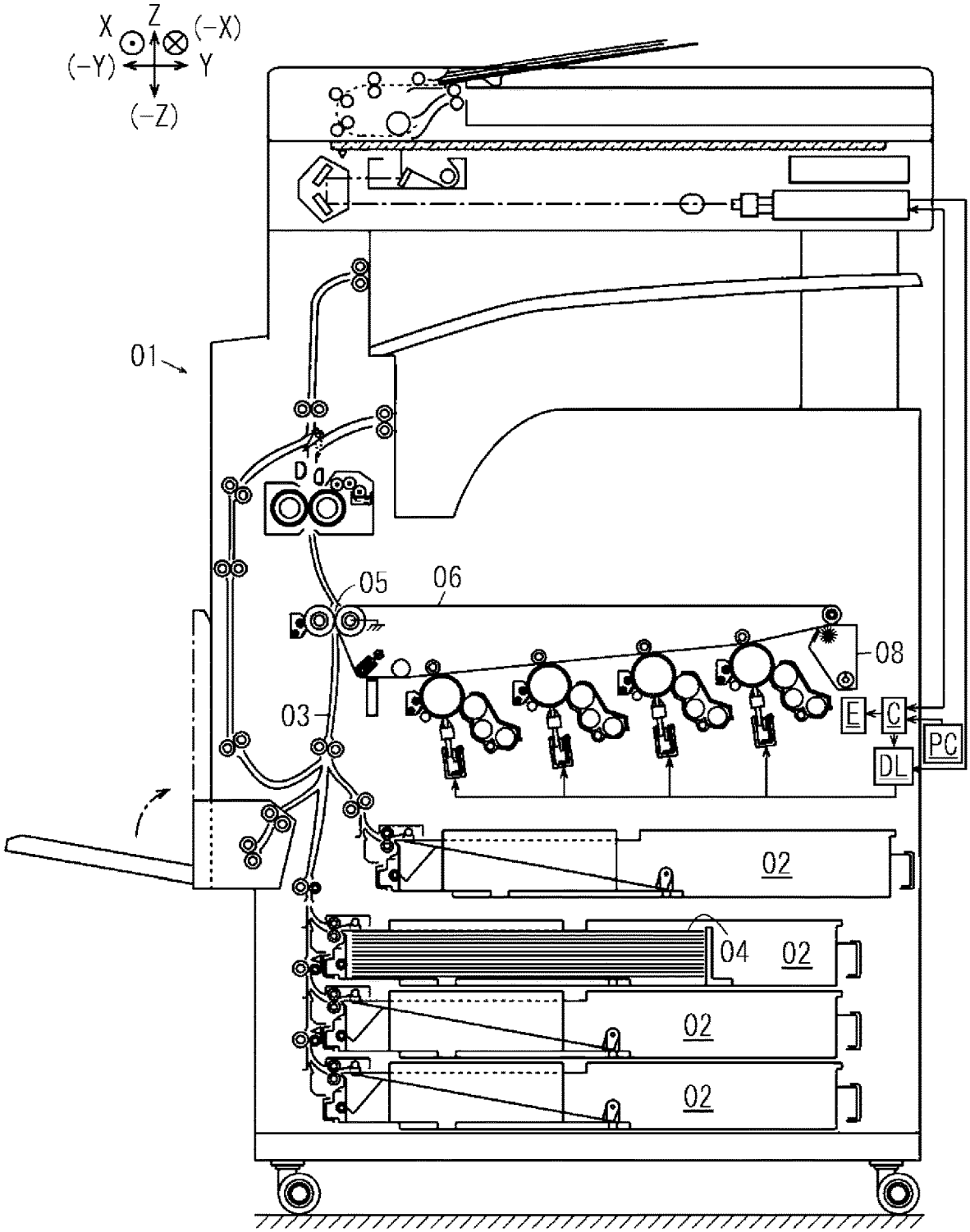
FIG. 2 RELATED ART
FIG. 2 is an explanatory view of a publicly known image forming apparatus of the related art.

FIG. 2 is an explanatory view of a publicly known image forming apparatus of the related art.

In the copier U according to Example 1 having the configuration, the first paper-feeding tray TR1 is disposed to be inclined such that the downstream side in a transport direction of the recording paper S is raised.

Here, in an image forming apparatus 01 of the related art illustrated in FIG. 2, a paper-feeding tray 02 is generally disposed horizontally, as with the second paper-feeding tray TR2. In a case in which the paper-feeding tray 02 is disposed horizontally with a paper feeding path 03 extending upward, the traveling direction of recording paper 04 is horizontal at the time of paper feeding. The traveling direction is, however, curved upward after paper feeding, and the recording paper 04 is transported upward in the paper feeding path 03. Therefore, in particular, when the traveling direction of the recording paper 04 is curved and when the rear end of the recording paper 04 is flapped, the recording paper 04 may come into contact with a wall surface of the paper feeding path 03 and may be rubbed. When the recording paper 04 is rubbed, paper dust adhering to a surface of the recording paper 04 may easily fall off from the recording paper 04. Thus, the amount of paper dust on the recording paper 04 that reaches a secondary transfer region 05 may be reduced as a result.

In contrast, when the downstream side is inclined to be raised, as with the first paper-feeding tray TR1 according to Example 1, the traveling direction of the recording paper S is directed obliquely upward at the time of paper feeding, and the change in the traveling direction is small compared with the second paper-feeding tray TR2. Therefore, contact with the paper-feeding path SH1, specifically, contact pressure is weak compared with the second paper-feeding tray TR2. Thus, the amount of paper dust that falls off from the recording paper S fed from the first paper-feeding tray TR1 is smaller than the amount of paper dust that falls off from the recording paper S of the second paper-feeding tray TR2. As a result, the amount of paper dust that reaches the secondary transfer region Q4 may be large.

Figure 3A:
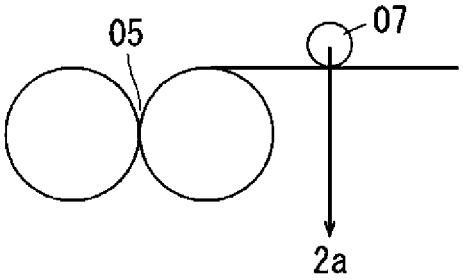
FIG. 3A RELATED ART
FIGS. 3A and 3B are explanatory views of gravity that acts on paper dust adhering to an intermediate transfer belt, FIG. 3A being an explanatory view of a case of a configuration of the related art illustrated in FIG. 2, FIG. 3B being an explanatory view of a case of Example 1.
Figure 3B:
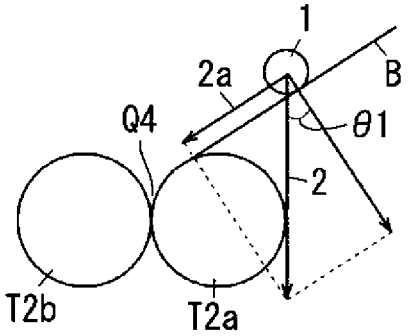

FIGS. 3A and 3B are explanatory views of gravity that acts on paper dust adhering to an intermediate transfer belt, FIG. 3A being an explanatory view of a case of a configuration of the related art illustrated in FIG. 2, FIG. 3B being an explanatory view of a case of Example 1.

In the image forming apparatus 01 of the related art illustrated in FIG. 2, the surface of an intermediate transfer belt 06 is moved horizontally on the downstream side of the secondary transfer region 05. Therefore, paper dust 07 adhering to the surface of the intermediate transfer belt 06 that has passed through the secondary transfer region 05 is subjected to gravity in a direction of being pressed against the surface of the intermediate transfer belt 06, as illustrated in FIG. 3A. Thus, the paper dust 07 on the intermediate transfer belt 06 does not easily fall off from the intermediate transfer belt 06 and is sent as it is to a belt cleaner 08. Consequently, the cleaning performance of the belt cleaner 08 may be exceeded when the amount of paper dust that enters the secondary transfer region 05 is increased. Accordingly, in the configuration of the related art, image quality may be degraded due to cleaning failure.

To cope with this, in Example 1, the intermediate transfer belt B is also inclined upward from the secondary transfer region Q4 toward the downstream side, as illustrated in FIG. 1, in accordance with the arrangement in which the downstream side of the first paper-feeding tray TR1 is inclined to be raised. Therefore, as illustrated in FIG. 3B, the direction of gravity 2 that acts on paper dust 1 adhering to the intermediate transfer belt B is inclined with respect to the movement direction of the surface of the intermediate transfer belt B. Thus, the gravity 2 has a component 2*a* along the surface of the intermediate transfer belt B. Consequently, even when a large amount of the paper dust 1 adheres to the intermediate transfer belt B in the secondary transfer region Q4, part of the paper dust 1 may easily move to rotate toward the side of the secondary transfer region Q4 due to the effect of the component 2*a* of the gravity along the surface of the intermediate transfer belt B, vibrations of the rotation of the intermediate transfer belt B, and the like. Therefore, the amount of paper dust that is sent to the belt cleaner CLb may be easily reduced compared with the configuration of the related art illustrated in FIG. 2 and FIG. 3A. The fallen paper dust may easily fall and float in the inside of the copier U. However, a collecting container for collecting paper dust may be disposed below the secondary transfer region Q4, or a fan or the like for discharging floating paper dust to the outside may be disposed.

Accordingly, in the copier U according to Example 1, generation of failure in removing of paper dust may be suppressed, and degradation of image quality may be suppressed compared with the configuration of the related art.

In Example 1, the belt cleaner CLb is disposed to face the drive roller Rd. The drive roller Rd rotates around a drive shaft and receives a driving force from a motor or the like (not illustrated). The drive roller Rd is thus generally firmly fixed so that misregistration does not easily occur. Here, in a case in which there is no member that faces the belt cleaner CLb with the intermediate transfer belt B interposed therebetween or in a case in which a member that is not firmly fixed faces the belt cleaner CLb, a contact state between the belt cleaner CLb and the intermediate transfer belt B may change when, for example, the intermediate transfer belt B cockles, and cleaning performance may be degraded. To cope with this, in Example 1, the belt cleaner CLb is disposed to face the drive roller Rd in which misregistration may not easily occur, and cleaning performance may be stable. Therefore, failure in cleaning of paper dust may be also stably suppressed.

In Example 1, the first paper-feeding tray TR1 and the intermediate transfer belt B are disposed to overlap each other as viewed from above in the direction of gravity. In particular, the paper-feeding side (left side) of the first paper-feeding tray TR1 and the secondary transfer region Q4 (left side) of the intermediate transfer belt B are disposed to overlap each other in the up-down direction. When the paper-feeding side of the first paper-feeding tray TR1 and the secondary transfer region Q4 are disposed at positions opposite to each other in the left-right direction, the paper-feeding path SH1 has a "transverse S-shape" after paper feeding at the first paper-feeding tray TR1. Thus, the paper-feeding path SH1 may be long. In the paper-feeding path SH1 having a long length, paper dust may easily fall off midway of the paper-feeding path SH1. In contrast, in Example 1, the paper-feeding path SH1 is short and an increase in the size of the copier U may be suppressed while the amount of paper dust sent to the secondary transfer region Q4 may easily become large and an effect of suppressing cleaning failure according to the present disclosure may be exerted.

In Example 1, the paper-feeding side (left side) of the first paper-feeding tray TR1 and the secondary transfer region Q4 (left side) of the intermediate transfer belt B in the fixing device F are also disposed to overlap each other in the up-down direction. Therefore, compared with a case in which the fixing device F is disposed reversely in the left-right direction, an increase in the length of the transport path for the recording paper S may be suppressed, and an increase in the size of the copier U may be suppressed.

Example 2

Figure 4:
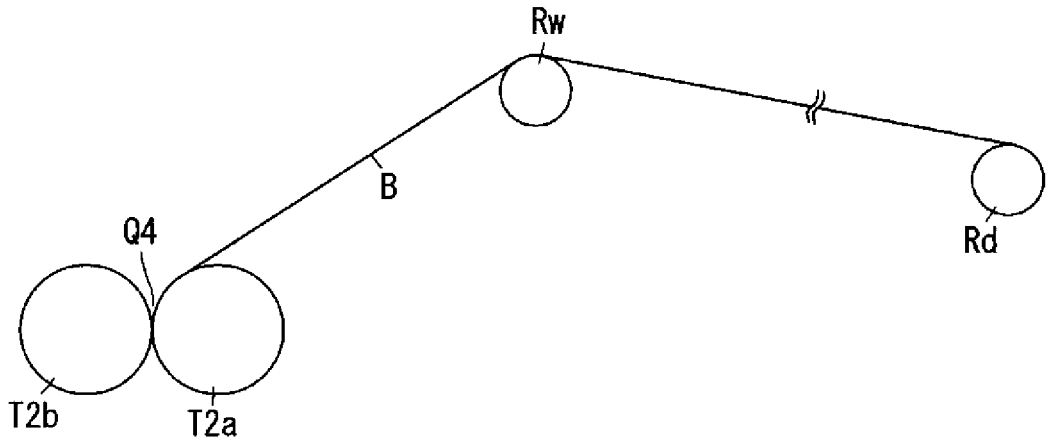
FIG. 4 is an explanatory view of Example 2 and is a view corresponding to FIG. 3B.

FIG. 4 is an explanatory view of Example 2 and is a view corresponding to FIG. 3B.

In FIG. 4, the drive roller Rd is disposed below the walking roller Rw in the direction of gravity in the copier U according to Example 2, differently from Example 1.

Operation in Example 2

In the copier U according to Example 2 having the configuration, the paper dust 1 may easily rotate toward the side of the secondary transfer region Q4 due to the inclination of the intermediate transfer belt B between the backup roller T2*a* and the walking roller Rw, and an effect of suppressing paper dust that reaches the belt cleaner CLb may be obtained.

Modifications

Examples according to the present disclosure have been described above in detail. The present disclosure is, however, not limited to the examples and may be variously changed within the scope of the gist of the present disclosure described in the claims. Modifications (H01) to (H04) of the present disclosure will be exemplified below.

(H01) In the examples, the copier U as one example of an image forming apparatus is exemplified. The present disclosure is, however, not limited thereto and is applicable to a facsimile machine and applicable to a complex machine or the like having multiple functions of a facsimile machine, a printer, a copier, and the like. In addition, the present disclosure is not limited to a multicolor-development image forming apparatus and may be configured by a single-color, that is, monochromatic image forming apparatus.

(H02) In the examples, the exemplified specific numerical values may be changed, as appropriate, in accordance with changes in design and specifications. Therefore, when ease of adhering of paper dust to the intermediate transfer belt B changes depending on the material of the surface of the intermediate transfer belt, the inclination angle θ1 of the intermediate transfer belt B may be also changed in accordance with the change. In addition, the inclination angle θ2 of the first paper-feeding tray TR1 may be also changed, as appropriate, in accordance with the maximum size of usable recording paper S and the lateral width of the copier U.

(H03) In the examples, the fixing device F, the paper-feeding side (left side) of the first paper-feeding tray TR1, and the secondary transfer region Q4 (left side) of the intermediate transfer belt B may be disposed to overlap each other in the up-down direction but are not limited thereto. The fixing device F, the paper-feeding side (left side) of the first paper-feeding tray TR1, and the secondary transfer region Q4 (left side) of the intermediate transfer belt B may be disposed at positions that differ from each other in the left-right direction.

(H04) In the examples, a case in which the intermediate transfer belt B is used as an image holding part is exemplified. The present disclosure is, however, not limited thereto. The present disclosure is also applicable to a case in which an image holding part like a photoreceptor belt is used.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a paper feeding part that houses a medium that is to be fed;

a belt-shaped image holding part that holds an image on a surface of the image holding part and rotates;

a transfer part that is disposed to face the image holding part and that transfers an image onto a medium from the image holding part in a final transfer region;

a cleaning part that removes a deposit on the surface of the image holding part that has passed through the final transfer region;

a first supporting part that supports the belt-shaped image holding part and that is disposed to face the transfer part;

a second supporting part that is disposed immediately downstream of the first supporting part in the rotation direction of the image holding part and that supports the belt-shaped image holding part, the second supporting part being disposed above the first supporting part in the direction of gravity; and a third supporting part downstream of the second supporting part, the third supporting part being disposed below the second supporting part in the direction of gravity, wherein:

the third supporting part receives a driving force that rotates the belt-shaped image holding part, a downstream side of the paper feeding part in a transport direction of a medium is inclined to be closer than an upstream side of the paper feeding part to the final transfer region in a direction of gravity, and the image holding part is inclined upward on a downstream side of the final transfer region toward the downstream side in a rotation direction of the image holding part.

2. The image forming apparatus according to claim 1, wherein the cleaning part is disposed to face the third supporting part with the belt-shaped image holding part interposed therebetween.

3. The image forming apparatus according to claim 2, comprising:

wherein the second supporting part is disposed between the first supporting part and the third supporting part.

4. The image forming apparatus according to claim 1, wherein the final transfer region is disposed above a downstream end of the paper feeding part in the transport direction of the medium.

5. The image forming apparatus according to claim 2, wherein the final transfer region is disposed above a downstream end of the paper feeding part in the transport direction of the medium.

6. The image forming apparatus according to claim 3, wherein the final transfer region is disposed above a downstream end of the paper feeding part in the transport direction of the medium.

7. The image forming apparatus according to claim 4, wherein the paper feeding part and the image holding part are disposed to overlap each other as viewed from above in the direction of gravity.

8. The image forming apparatus according to claim 5, wherein the paper feeding part and the image holding part are disposed to overlap each other as viewed from above in the direction of gravity.

9. The image forming apparatus according to claim 4, comprising:

a fixing device that fixes an image transferred onto a medium, the fixing device being disposed above the final transfer region in the direction of gravity.

* * * * *